US006045035A

United States Patent [19]

Murakami et al.

[11] Patent Number: 6,045,035

[45] **Date of Patent: *Apr. 4, 2000**

[54] INTERLOCKING MAILING PACKAGE

[75] Inventors: Mark S. Murakami, Sparks; Nathan Morris Saks, Reno, both of Nev.

[73] Assignee: Microflex Corporation, Reno, Nev.

[ * ] Notice: This patent issued on a continued prosecution application filed under 37 CFR 1.53(d), and is subject to the twenty year patent term provisions of 35 U.S.C. 154(a)(2).

[21] Appl. No.: 08/963,965

[22] Filed: Nov. 4, 1997

[51] Int. Cl.[7] ..... B65D 27/22

[52] U.S. Cl. ..... 229/84; 206/63.3; 206/388; 229/87.15; 229/103.2

[58] Field of Search ..... 229/84, 87.15, 229/87.16, 87.17, 103.2, 87.01; 206/63.3, 388, 299

[56] References Cited

U.S. PATENT DOCUMENTS

| | | | |
|---|---|---|---|
| 149,484 | 4/1874 | Kelly et al. | 229/84 |
| 649,768 | 5/1900 | Sherriff | 229/84 |
| 1,062,643 | 5/1913 | Fox | 229/87.17 |
| 1,278,115 | 9/1918 | Darr | 229/84 |
| 1,352,962 | 9/1920 | Hitzigrath | 206/299 |
| 1,720,679 | 7/1929 | Karn | 229/87.15 |
| 1,731,996 | 10/1929 | Appelbaum | 229/87.15 |
| 1,780,558 | 11/1930 | Kavanau | 229/87.15 |
| 3,746,152 | 7/1973 | Allen | 229/87.16 |
| 4,334,611 | 6/1982 | Watson et al. | 229/103.2 |
| 4,727,988 | 3/1988 | Erickson | 229/84 |
| 4,765,485 | 8/1988 | Perkins | 229/84 |

*Primary Examiner*—Stephen P. Garbe
*Attorney, Agent, or Firm*—Evan M. Kent; Stewart L. Gitler

[57] ABSTRACT

A mailing package comprises a package body having a first section, a second section, and a third section, the first section connected to the second section by a first foldable joint;

the second section is connected to a first end section through a second foldable joint and a second end section through a third foldable joint and having a plurality of end slits cut therethrough disposed near the end flaps, a first and second guide receiver slit, and a main locking flap receiver slit; and the third section connected through a fourth foldable joint to the second section, and to a first locking end flap, a second locking end flap, and a main locking flap having a main locking tab and a first and second guide tab;

the sections joined such that when the second flap is folded over the third flap the plurality of end slits are presented to the first and second locking end flaps, the first and second guide tabs are received in the first and second guide receiver slits and the main locking receiver slit is presented to the main locking flap.

8 Claims, 2 Drawing Sheets

INTERLOCKING MAILING PACKAGE

BACKGROUND OF THE INVENTION

1. Field of the Invention

This invention relates to a mailing apparatus, more particularly this invention relates to an apparatus for mailing small, soft samples.

2. State of the Art

It is frequently desired to send small samples by mail or courier. The packaging for sending the samples must be able to resist disintegration with the expected heavy handling by postal and other handling personnel. Moreover, there is a desire to ship samples, and the like, in smaller substantially letter-sized packages rather than larger parcels. However, packages shipped as letters must be able to fit in the flat sorter at the post office. The need for a letter package through which bulky material can be shipped is therefore a problem that needs a solution.

SUMMARY OF THE INVENTION

This invention provides a mailing packaging comprising:

a package body having a first section, a second section, and a third section, the first section connected to the second section by a first foldable joint;

the second section is connected to a first end section through a second foldable joint and a second end section through a third foldable joint;

the second section having a plurality of end slits cut therethrough disposed near the end flaps, a first and second guide receiver slit, and a main locking flap receiver slit;

a third section connected through a fourth foldable joint to the second section, the third section connected to a first locking end flap, a second locking end flap, and a main locking flap having a main locking tab and a first and second guide tab; and the sections joined such that when the second flap is folded over the third flap the plurality of end slits are presented to the first and second locking end flaps, the first and second guide tabs are received in the first and second guide receiver slits and the main locking receiver slit is presented to the main locking flap. The first flap and the second flap are joined to the third section by a seventh foldable joint.

BRIEF DESCRIPTION OF THE DRAWINGS

FIG. 2 shows the view of FIG. 1 with the first and second end flaps folded in.

FIG. 3 shows the view of FIG. 2 with the first section folded in.

DETAILED DESCRIPTION OF THE PREFERRED EMBODIMENT

Figure 1:
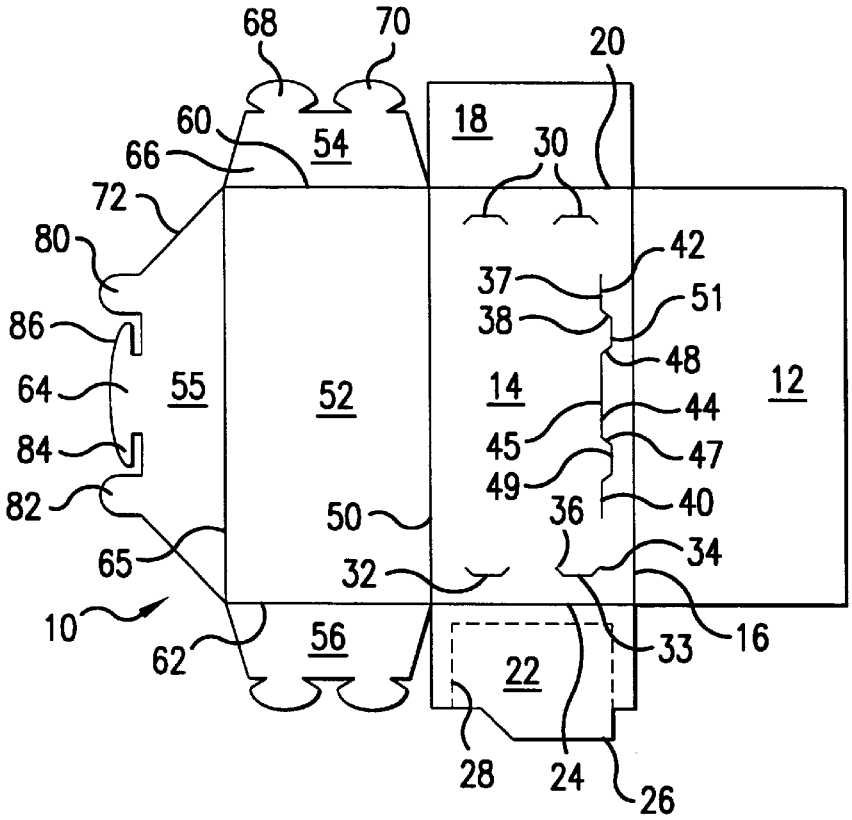
FIG. 1 shows a plan view of an embodiment of the present invention in an unfolded configuration.

Referring to FIG. 1, the mailer of the present invention 10 has three main foldable sections. The first section 12 is connected to the second section 14 by a first foldable joint 16. The second section 14 is connected to a first end section 18 through a second foldable joint 20 and a second end section 22 through a third foldable joint 24. The second end section 22 preferably has a detachable card 26 or similar item suitable for placement in a Rolodex® or similar filing system. The card is easily removed by tearing it from the second end section 22 along a series of pre-scored lines 28. The second section also defines a series of slits cut therethrough. The first end slits 30 and the second end slits 32 are disposed near the first and second end sections of the second section. Each end slit defines a center segment 33 and two end segments 34 and 36 angling outwardly toward the joints 16 and 50 of the second section. There are also a first 40 and a second 42 guide receiver slit. The guide receiver slits each have a first segment 37 ending in an angled straight end segment 38 tending away from the center of the second section. A main locking flap receiver slit 44 has a middle segment 45 that ends in first 47 and second 48 angled transition segments tending away from the center of the second section. The first 47 and the second 48 angled transition segments terminate in a first 49 and second 51 terminal segments which are substantially parallel with the middle segment 45.

The second section 14 is connected through a fourth foldable joint 50 to the third section 52. The third section is connected to a first locking end flap 54 and a second locking end flap 56. The first locking end flap 54 is joined to the third section 52 through a fifth foldable joint 60 and the second locking end flap is joined to the third section by a sixth foldable joint 62. A main locking flap 55 is joined to the third section by a seventh foldable joint 65.

The first locking end flap 54 and the second locking end flap 56 are substantially similar. The first locking end flap 54 has a body section 66 and a first 68 and a second 70 locking tab. The locking tabs extend from the body section 66 with an angle cut and terminate with a substantially circular end edge. The main locking flap 55 extends from the third section 52 on a pair of sharply angled edges 72 that meets at a junction of the main locking flap 55, the third section 52, and the first 54 or second 56 locking end flap. At the end of the sharply angled edge 72 is a pair of guide members 80 and 82 without interlocking edges terminating in a substantially semi-circular edge. Between the two guide members is the main locking Lab 64 which has a first lock tab 84 and second lock tab 86 extending over the body of the main locking flap. The main locking tab 64 terminates in a curved edge.

Figure 2:
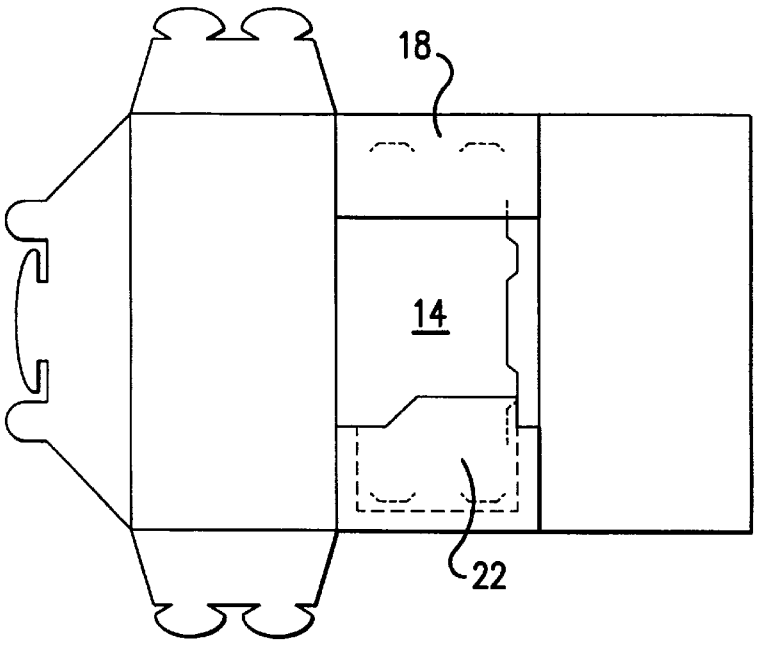

Referring now to FIG. 2, in use the goods desired to be mailed are placed on the second section 14 and first 18 and second 22 end sections of the second section are folded into the second section, securing the goods therein. One particularly preferred good for mailing is latex gloves, although any samples of similar items such as cloth samples, rubber goods, apparel, and leather goods. Even food items contained in hermetically sealed plastic pouches can be shipped in a container of this invention.

Figure 3:
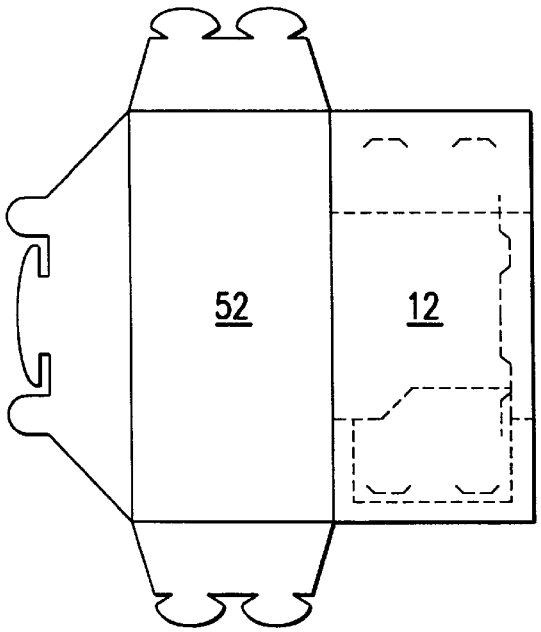

Referring now to FIG. 3, the first section 12 is folded over the second section 14 (shown superimposed in this view), completely enclosing the goods contained on the second section.

Figure 4:
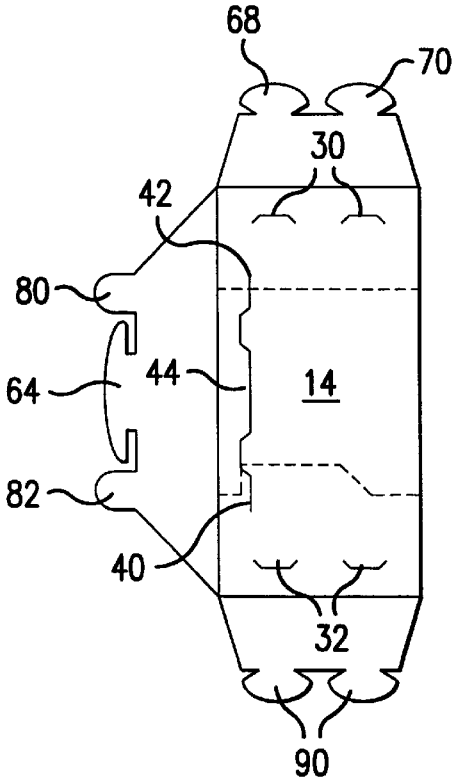
FIG. 4 shows the view of FIG. 3 with the second section folded over and the slits presented to receive the interlocking tabs.

Referring now to FIG. 4, the second section 14 is folded onto the third section 52 presenting the end slits 30 and 32 on the second section to the first and second locking tabs 68 and 70 on the first 54 and second 56 end flaps. The first 80 and second 82 guide members are presented to the first 40 and second 42 guide receiver slits and the main locking tab 64 is presented to the main locking flap receiver slit 44. When the locking members are inverted into their respective slits the package and its contents are suitable for mailing and may be mailed without fear of the package inadvertently opening in the mail.

The package may be mailed as a letter rather than as a parcel because the assembled package, with the sample, is flat enough to go through the flat sorting machines of the post office. All the edges of the final folded package are flat and straight, allowing the easy access through the mail sorters.

The sample mailer of the present invention can be made in a variety of sizes, the preferred sizes having a second section of between about 5 to 15 inches by 2 to 8 inches, more preferred being between 9 to 13 inches by about 4 to 7 inches. It should be realized that the shape of the first section need not be rectangular, nor must it be the same size as the second section. The third section need not be exactly the same size as the second section, although that is greatly preferred, but the attachment flaps must be able to reach around the folded package to attach to the receiving slots.

The mailer of the present invention can be made of cardboard or similar paper substance, or in special instances it could be made of plastic or similar type material.

This invention has been defined by reference to specific embodiments and examples of the invention. It will be apparent to those skilled in the art that various modifications, adaptations, and variations of the invention can be made without departing form the spirit of the invention. The appended claims are intended to cover all such modifications, adaptations, and variations.

We claim:

1. A mailing package comprising:

a package body having a first section, a second section, and a third section, the first section connected to the second section by a first foldable joint;

the second section is connected to a first end section through a second foldable joint and a second end section through a third foldable joint and having a plurality of end slits cut therethrough disposed near said first end section and the second end section, a first and second guide receiver slit, and a main locking flap receiver slit;

the third section connected through a fourth foldable joint to the second section, and to a first locking end flap through a fifth foldable joint, a second locking end flap through a sixth foldable joint, and a main locking flap having a main locking tab and a first and second guide member through a seventh foldable joint; and the first, second and third sections joined such that when the first section is folded over the second section and the second section is folded over the third section the plurality of end slits are presented to the first and second locking end flaps, the first and second guide tabs are received in the first and second guide receiver slits and the main locking flap receiver slit is presented to the main locking flap.

2. The mailer of claim 1 wherein said first locking end flap and the second locking end flap are substantially similar.

3. The mailer of claim 1 wherein said first locking end flap has a body section and a first and a second locking tab.

4. The mailer of claim 1 wherein the main locking flap has an edge extending from the third section from a junction of the main locking flap and the third section, the angled edge terminating in one of said guide member without interlocking edges, an edge of the main locking flap between the two guide members forming said main locking tab having a first tab and a second tab extending substantially over the body of the main locking flap.

5. The mailer of claim 1 wherein the second end section of the second section defines a detachable card.

6. The mailer of claim 5 wherein the detachable card is easily removed by tearing it from a second end section along a series of pre-scored lines.

7. The mailer of claim 1 wherein the main locking flap receiver slit defines a middle segment ending in a first angled transition segment and a second angled transition segment tending away from the center of the second section; the first and second angled transition segments terminating in a first and a second terminal segment disposed substantially parallel with the middle segment.

8. The mailer of claim 1 wherein the first and second guide receiver slits have a center segment and two end segments angling outwardly towards the center of the second section.

* * * * *